US012698014B2

(12) United States Patent
Sano et al.

(10) Patent No.: US 12,698,014 B2
(45) Date of Patent: Aug. 4, 2026

(54) RAILCAR BODYSHELL

(71) Applicant: Kawasaki Railcar Manufacturing Co., Ltd., Hyogo (JP)

(72) Inventors: Atsushi Sano, Kobe (JP); Shinichiro Hata, Kobe (JP); Yuji Toya, Kobe (JP); Kazuyoshi Ikushima, Kobe (JP); Atsushi Sano, Kobe (JP)

(73) Assignee: KAWASAKI RAILCAR MANUFACTURING CO., LTD., Hyogo (JP)

( * ) Notice: Subject to any disclaimer, the term of this patent is extended or adjusted under 35 U.S.C. 154(b) by 755 days.

(21) Appl. No.: 17/617,943

(22) PCT Filed: Jun. 8, 2020

(86) PCT No.: PCT/JP2020/022577
§ 371 (c)(1),
(2) Date: Dec. 10, 2021

(87) PCT Pub. No.: WO2020/250861
PCT Pub. Date: Dec. 17, 2020

(65) Prior Publication Data

US 2022/0306166 A1 Sep. 29, 2022

Related U.S. Application Data

(60) Provisional application No. 62/859,335, filed on Jun. 10, 2019.

(51) Int. Cl.
*B61D 15/06* (2006.01)
*B61D 17/06* (2006.01)
(Continued)

(52) U.S. Cl.
CPC ..... *B61D 15/06* (2013.01); *B61D 17/06* (2013.01); *B61F 1/10* (2013.01); *B61F 19/04* (2013.01); *B61G 11/16* (2013.01)

(58) Field of Classification Search
CPC . B61D 15/06; B61D 17/06; B61F 1/10; B61F 1/08; B61F 1/14; B61F 19/04; B61G 11/16
See application file for complete search history.

(56) References Cited

U.S. PATENT DOCUMENTS 2,251,347 A * 8/1941 Williams ..... B61D 15/06 267/140
2,709,527 A * 5/1955 Jones ..... B61F 19/04 213/221
(Continued)

FOREIGN PATENT DOCUMENTS

CN 109094588 A * 12/2018 ..... B61D 17/04
JP 11-301476 A 11/1999
(Continued)

*Primary Examiner* — Cheng Lin
(74) *Attorney, Agent, or Firm* — XSENSUS LLP

(57) ABSTRACT

An object is to provide a railcar bodyshell whose deformation behavior at the time of collision is stable. The railcar bodyshell includes an anti-climber projecting from an end beam outward in a car longitudinal direction. The anti-climber includes a starting point portion that serves as a starting point of bending of the end beam when collision has occurred, and the end beam is bent by a collision load. The starting point portion is disposed at a portion corresponding to a position between a front end of an energy absorber and a corner post in a car width direction.

8 Claims, 9 Drawing Sheets

(51) Int. Cl.

| | |
|---|---|
| ***B61F 1/10*** | (2006.01) |
| ***B61F 19/04*** | (2006.01) |
| ***B61G 11/16*** | (2006.01) |

(56) References Cited

U.S. PATENT DOCUMENTS

| | | | | |
|---|---|---|---|---|
| 6,196,135 | B1 * | 3/2001 | Kashima | B61D 15/06 105/396 |
| 6,263,805 | B1 * | 7/2001 | Taguchi | B61D 15/06 105/396 |
| 6,799,794 | B2 * | 10/2004 | Mochidome | B62D 21/152 296/203.02 |
| 9,493,173 | B2 * | 11/2016 | Hirashima | B61D 15/06 |
| 2004/0159263 | A1 * | 8/2004 | Yamamoto | B61F 1/10 105/392.5 |
| 2008/0060544 | A1 * | 3/2008 | Kawasaki | B61D 17/06 105/355 |
| 2008/0250965 | A1 | 10/2008 | Clark et al. | |
| 2019/0168782 | A1 | 6/2019 | Yu et al. | |
| 2020/0122752 | A1 * | 4/2020 | Luo | B61F 19/04 |

FOREIGN PATENT DOCUMENTS

| | | | |
|---|---|---|---|
| JP | 2000-052984 | A | 2/2000 |
| JP | 3015358 | A | 3/2000 |
| JP | 2001-088698 | A | 4/2001 |
| JP | 2004-090825 | A | 3/2004 |
| JP | 2008-062817 | A | 3/2008 |

* cited by examiner

RAILCAR BODYSHELL

CROSS-REFERENCE TO RELATED APPLICATIONS

The present application is based on PCT filing PCT/JP2020/022577, filed Jun. 8, 2020, which claims priority to U.S. Provisional Application No. 62/859,335, filed Jun. 10, 2019, the entire contents of each are incorporated herein by reference.

TECHNICAL FIELD

The present invention relates to a railcar bodyshell that deforms to absorb collision energy when collision occurs.

BACKGROUND ART

Conventionally used is a railcar bodyshell including: a crushable zone that is relatively allowed to deform at the time of collision; and a survival zone that accommodates occupants and the like and is not relatively allowed to deform at the time of the collision. According to the railcar bodyshell of PTL 1, the crushable zone of the front end portion of the bodyshell crushes at the time of the collision, and with this, the collision energy is absorbed by the crushable zone. Thus, the collision energy transmitted to the survival zone is reduced, and therefore, the deformation of the survival zone is reduced. According to the configuration of PTL 1, an energy absorbing beam is disposed at the crushable zone. At the time of collision, the energy absorbing beam crushes, and with this, the collision energy is absorbed by the energy absorbing beam. Moreover, an anti-climber that projects forward is disposed on a front surface of an end beam connecting front ends of side sills at a front end portion of a car.

CITATION LIST

Patent Literature

PTL 1: Japanese Laid-Open Patent Application Publication No. 2000-52984

SUMMARY OF INVENTION

Technical Problem

However, according to the configuration of PTL 1, a bent portion of the end beam may change depending on how the collision occurs. When deformation behavior of the end beam changes, crush behavior of the energy absorbing beam connected to the end beam also changes. To stably improve an effect of absorbing the collision energy by the energy absorbing beam, it is desired to stabilize the deformation behavior of the end beam at the time of the occurrence of the collision.

The present invention was made under these circumstances, and an object of the present invention is to provide a railcar bodyshell whose deformation behavior at the time of collision is stable.

Solution to Problem

A railcar bodyshell of the present invention includes: an underframe including an underframe main body and an end beam, the end beam being disposed at one of end portions of the underframe main body in a car longitudinal direction and extending in a car width direction; a corner post connecting the underframe and a roof bodyshell; an energy absorber that is arranged between the end beam and the underframe main body and absorbs part of collision energy; and an anti-climber that projects from the end beam outward in the car longitudinal direction and extends in the car width direction. The end beam includes an end beam main body portion and a side coupling portion, the side coupling portion connecting the end beam main body portion to the underframe main body in a corner post rear region that extends from the corner post inward in the car longitudinal direction. The anti-climber includes a starting point portion that serves as a starting point of bending of the end beam when collision has occurred, and the end beam is bent by a collision load. The starting point portion is disposed at a portion corresponding to a position between a front end of the energy absorber and the corner post in the car width direction.

In the railcar bodyshell configured as above, the anti-climber includes the starting point portion that serves as the starting point of the bending of the end beam. Therefore, the bodyshell can be configured such that when collision has occurred, the starting point portion of the anti-climber serves as the starting point, and the end beam is stably bent at the starting point. On this account, the state of the deformation of the bodyshell can be further stabilized. With this, the behavior of the deformation of the bodyshell can be predicted, and the shape of the bodyshell can be determined based on the predicted behavior of the deformation. Moreover, the starting point portion is located at a portion corresponding to a position between the front end of the energy absorber and the corner post in the car width direction. Therefore, when collision has occurred, the end beam is bent at a position corresponding to the starting point portion. The bent portion of the end beam moves inward in the car longitudinal direction, and a width direction outside portion of the bent end beam rotates about the corner post. With this, part of the collision energy is used by the rotation of the bent end beam, and therefore, further large collision energy can be absorbed by the end beam.

Advantageous Effects of Invention

According to the present invention, when collision has occurred, the bodyshell can stably deform. Therefore, the state of the deformation of the bodyshell when collision has occurred can be predicted, and the shape of the bodyshell can be determined in accordance with the assumed deformation such that the bodyshell further absorbs the collision energy. Moreover, since the end beam can absorb further large collision energy, the deformation that occurs in a space behind the end beam and the energy absorber can be further reduced. Therefore, the railcar bodyshell having higher safety can be provided.

DESCRIPTION OF EMBODIMENTS

Embodiment 1

Figure 1:
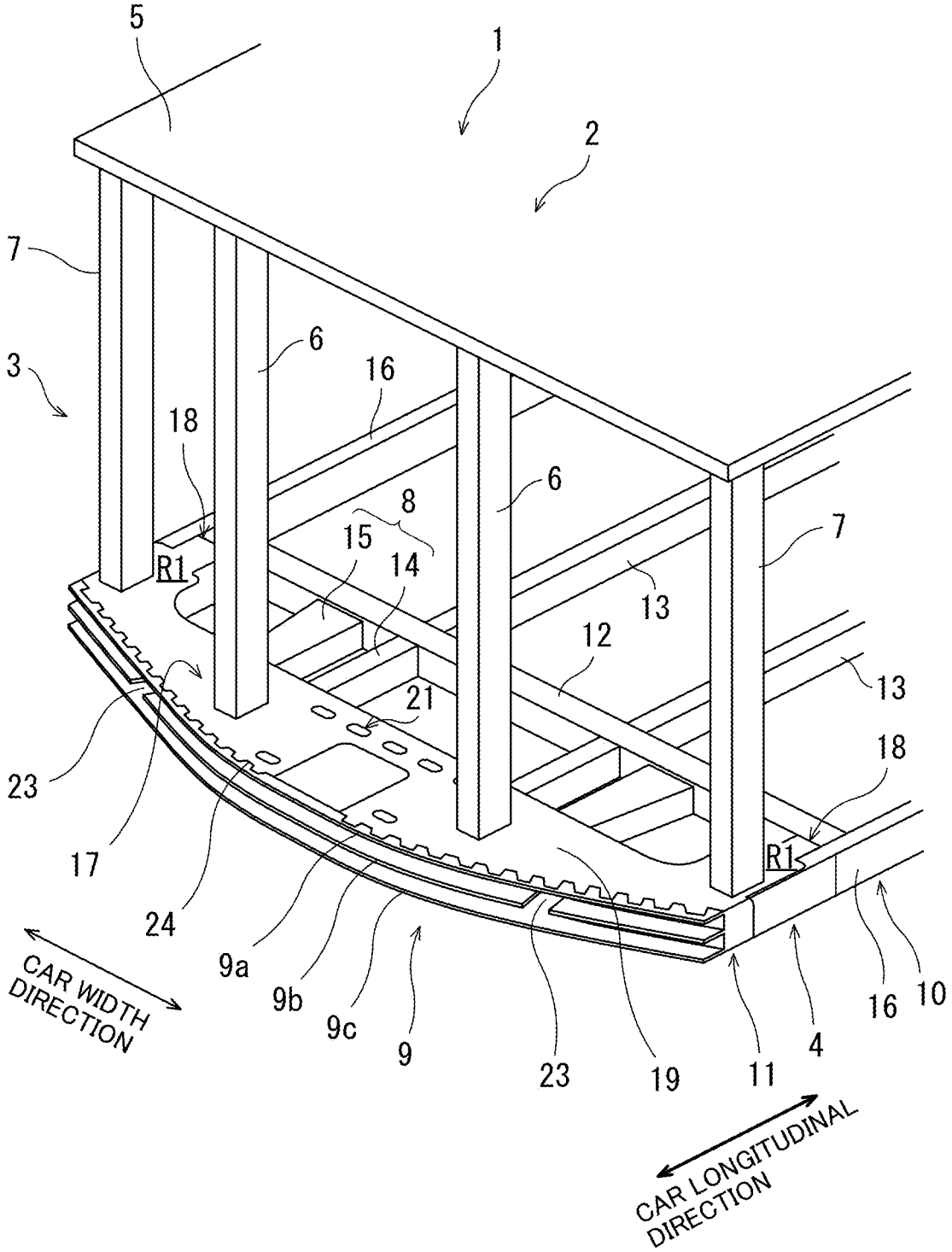
FIG. 1 is a perspective view showing a railcar bodyshell according to Embodiment 1 of the present invention when viewed from above.
Figure 2:
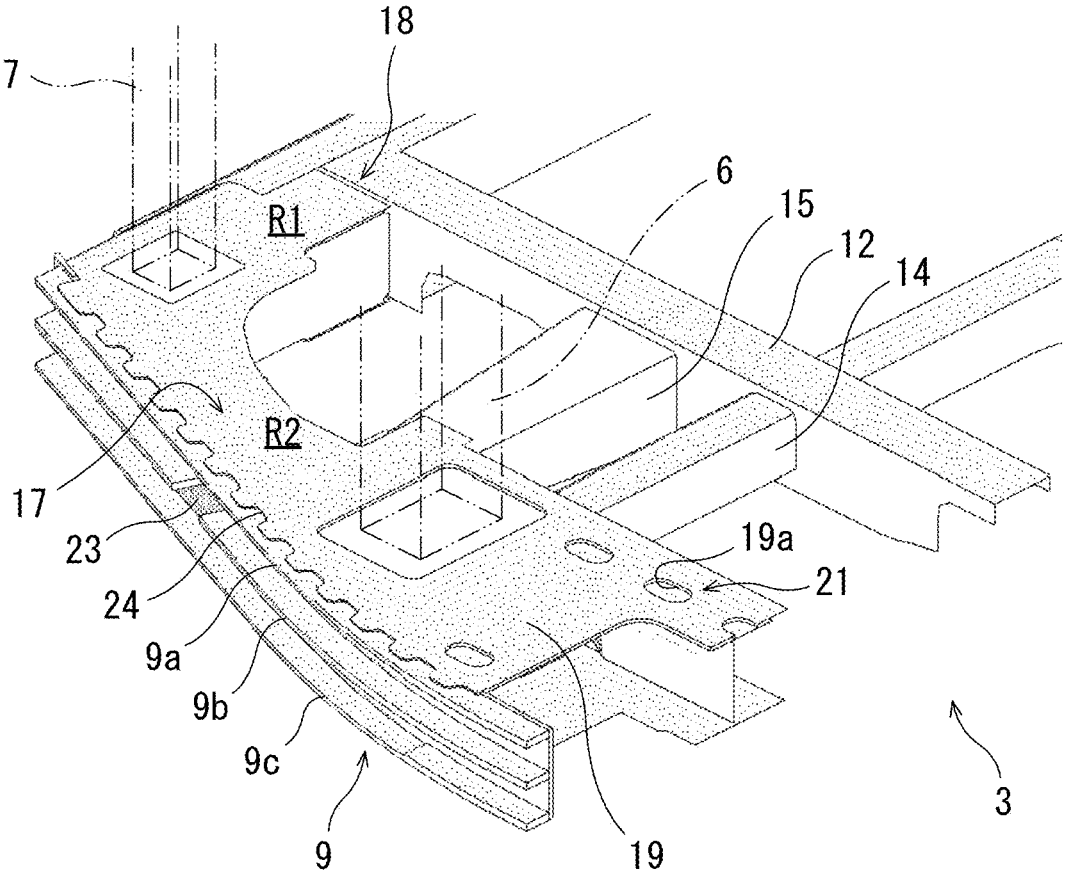
FIG. 2 is an enlarged perspective view showing only one side of the bodyshell of FIG. 1 in a car width direction.
Figure 3:
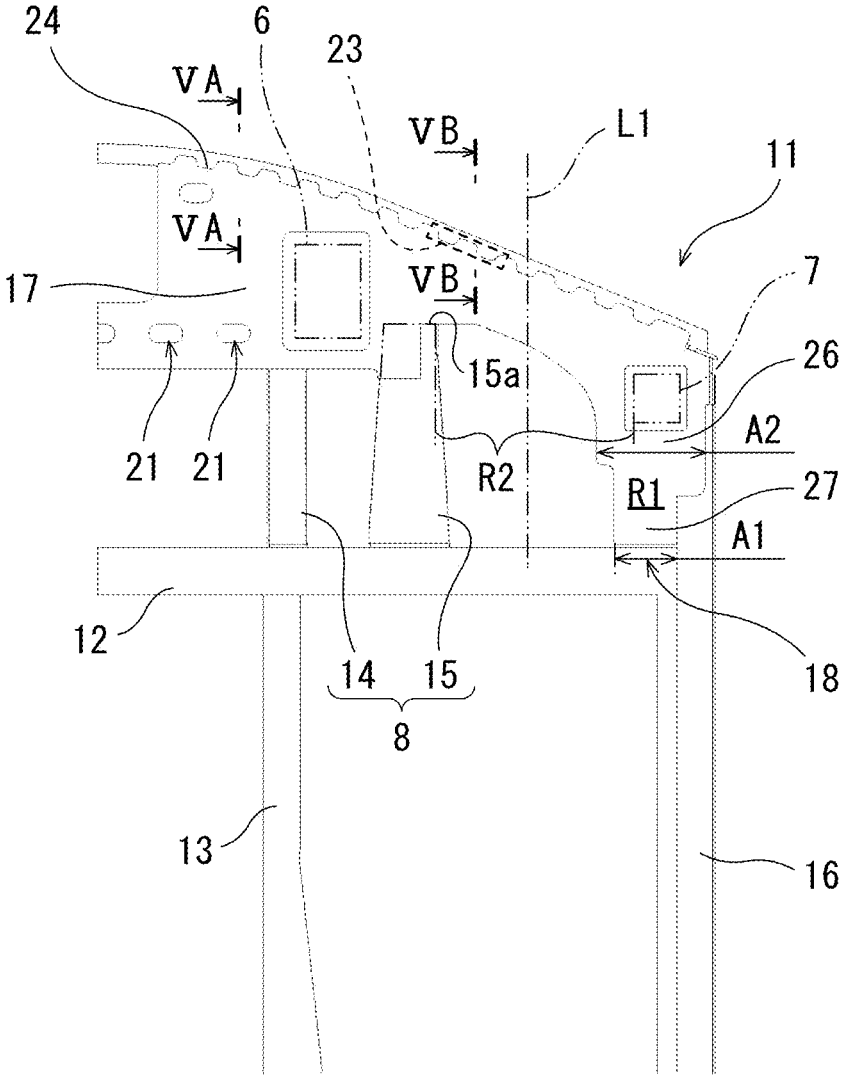
FIG. 3 is a plan view showing the bodyshell of FIG. 2.

Hereinafter, a railcar bodyshell according to Embodiment 1 will be described with reference to the attached drawings. FIG. 1 is a perspective view showing a front portion of a bodyshell 3 of a head car 2 of a railcar 1 according to Embodiment 1 when viewed from a diagonally front side. FIG. 2 is an enlarged perspective view showing only one side of the bodyshell 3 in a car width direction. FIG. 3 is a plan view showing only one side of the bodyshell 3 in the car width direction when viewed from above.

The railcar 1 includes cars coupled to each other. FIG. 1 shows the bodyshell 3 of the head car 2 among the cars. As shown in FIG. 1, the bodyshell 3 includes an underframe 4, a roof bodyshell 5, a pair of collision posts 6, a pair of corner posts 7, energy absorbers 8, and anti-climbers 9. The roof bodyshell 5 is arranged above the underframe 4. Each of the pair of collision posts 6 and the pair of corner posts 7 extends from a car longitudinal direction end portion of the underframe 4 to the roof bodyshell 5. The energy absorbers 8 are disposed inside the underframe 4 and absorb part of collision energy acting on the underframe 4 when collision has occurred.

The underframe 4 includes an underframe main body 10 and an end beam 11 disposed in front of the underframe main body 10 in a car longitudinal direction. The underframe main body 10 includes a pair of side sills 16, a frame 12, and a pair of center sills 13. The pair of side sills 16 are located at both sides of the bodyshell 3 in the car width direction and extend in the car longitudinal direction. The frame 12 connects the pair of side sills 16 to each other. The end beam 11 connects car longitudinal direction end portions of the pair of side sills 16 to each other and extends in the car width direction. The pair of center sills 13 are disposed at positions inside the side sills 16 in the car width direction.

The energy absorbers 8 connect the frame 12 and the end beam 11. In the present embodiment, two energy absorbers 8 are disposed at the bodyshell 3. The energy absorbers 8 include: a pair of inner energy absorbers 14 disposed at an inner side in the car width direction; and a pair of outer energy absorbers 15 disposed at an outer side in the car width direction. In each of the inner energy absorbers 14, a sectional area of a surface orthogonal to the car longitudinal direction is constant in the car longitudinal direction. Moreover, in each of the outer energy absorbers 15, a sectional area of a surface orthogonal to the car longitudinal direction increases toward an inner side in the car longitudinal direction.

The end beam 11 includes an end beam main body portion 17 and side coupling portions 18. Each of the side coupling portions 18 connects the end beam main body portion 17 to the frame 12 of the underframe main body 10 in a corner post rear region R1 extending from the corner post 7 toward the inner side in the car longitudinal direction. In the corner post rear region R1, the end beam 11 includes a first portion 26 and a second portion 27. The first portion 26 is located adjacent to and behind the corner post 7, and the second portion 27 is located behind the first portion 26. The second portion 27 includes the side coupling portion 18. As shown in FIG. 3, a sectional area of a surface of the side coupling portion 18 which surface is orthogonal to the car longitudinal direction of the end beam 11 is represented by A1. Moreover, at a car end side position of the side coupling portion 18, a sectional area of a surface of the end beam 11 which surface is orthogonal to the car longitudinal direction is represented by A2. At this time, the sectional area A1 of the surface of the side coupling portion 18 which surface is orthogonal to the car longitudinal direction is smaller than the sectional area A2 of the surface of the end beam 11 which surface is orthogonal to the car longitudinal direction at the car end side position of the side coupling portion 18. Moreover, rigidity of the first portion 26 of the end beam 11 in the car longitudinal direction is higher than rigidity of the second portion 27 of the end beam in the car longitudinal direction. To be specific, the second portion 27 of the end beam 11 deforms and crushes in the car longitudinal direction more easily than the first portion 26 of the end beam 11.

As shown in FIGS. 1-3, the end beam 11 is configured such that: a car width direction middle portion of a car longitudinal direction tip portion of the end beam 11 most projects outward in the car longitudinal direction; and as the car longitudinal direction tip portion extends outward in the car width direction, the car longitudinal direction tip portion is located at the inner side in the car longitudinal direction. To be specific, a car end side and car width direction middle portion of the end beam 11 most projects outward in the car longitudinal direction.

The end beam 11 includes an upper plate portion 19 located at an upper portion of the end beam main body portion 17. The upper plate portion 19 is joined to the end beam main body portion 17 by welding. Moreover, the upper plate portion 19 includes through holes 21 penetrating in a thickness direction.

Figure 4:
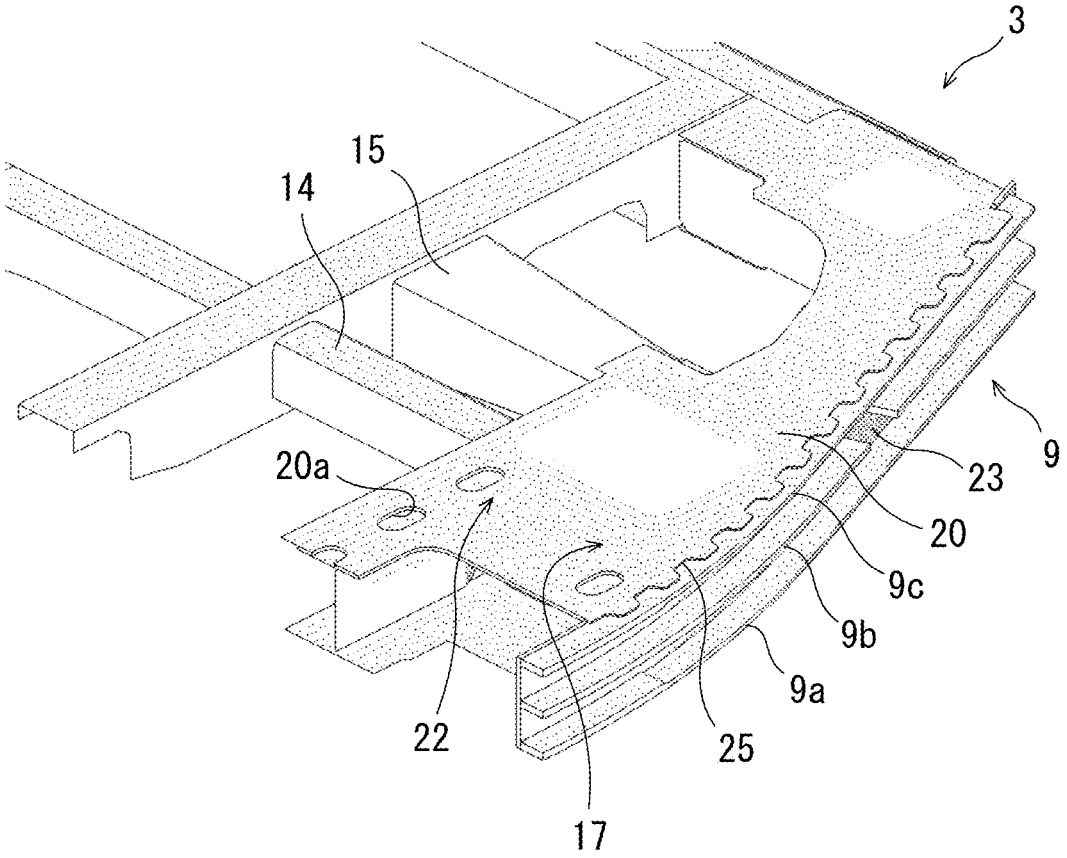
FIG. 4 is a perspective view showing the bodyshell of FIG. 1 when viewed from below.

The end beam 11 includes a lower plate portion 20 located at a lower portion of the end beam main body portion 17. FIG. 4 is a perspective view showing the bodyshell 3 when viewed from below. The lower plate portion 20 is joined to the end beam main body portion 17 by welding. The lower plate portion 20 includes through holes 22 penetrating in a thickness direction. The through holes 22 are located at positions of the lower plate portion 20 which positions correspond to the through holes 21 located at the upper plate portion 19.

At an upper side of the end beam 11, the upper plate portion 19 and the end beam main body portion 17 are joined to each other by continuous fillet welding (so-called slot welding) along edge portions 19*a* (FIG. 2) of the upper plate portion 19, the edge portions 19*a* surrounding the respective through holes 21. At a lower side of the end beam 11, the upper plate portion 19 and the end beam main body portion 17 are joined to each other by the slot welding along edge portions 20*a* (FIG. 4) of the lower plate portion 20, the edge portions 20*a* surrounding the respective through holes 22.

As shown in FIGS. 1-3, in the present embodiment, in each of the upper plate portion 19 and the lower plate portion 20, a portion (tip portion) thereof located at an outermost position in the car longitudinal direction is formed in a comb tooth shape. Since a welded portion 24 where the upper plate portion 19 and the end beam main body portion 17 are welded to each other is formed in the comb tooth shape, the welded portion 24 has length in not only the car width direction but also the car longitudinal direction. Therefore, the length of the welded portion 24 can be made longer than a case where the tip portion of the upper plate portion 19 simply extends linearly in the car width direction. Similarly, as shown in FIG. 4, since a welded portion 25 where the lower plate portion 20 and the end beam main body portion 17 are welded to each other is formed in the comb tooth shape, the welded portion 25 has length in not only the car width direction but also the car longitudinal direction. Therefore, the length of the welded portion 25 can be made longer than a case where the tip portion of the lower plate portion 20 simply extends linearly in the car width direction.

Figure 5A:
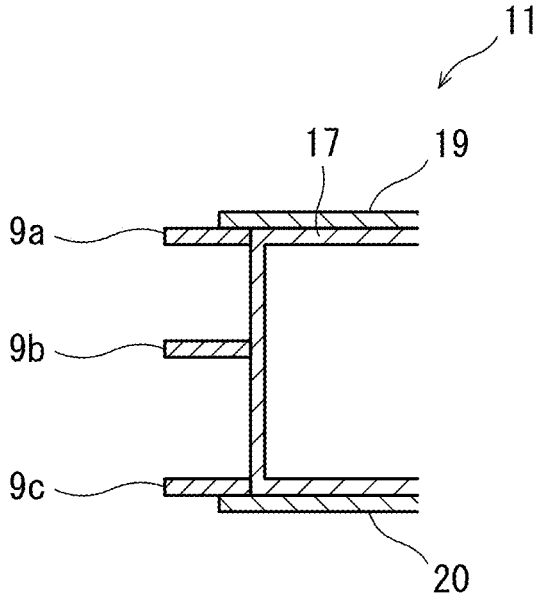
FIG. 5A is a sectional view taken along line VA-VA of FIG. 3.
Figure 5B:
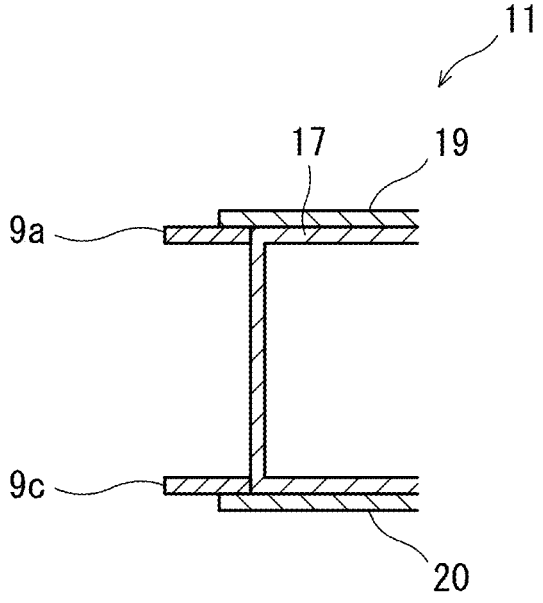
FIG. 5B is a sectional view taken along line VB-VB of FIG. 3.

As shown in FIG. 1, the anti-climbers 9 are disposed in front of the end beam 11, project from the end beam 11 outward in the car longitudinal direction, and extend in the car width direction. FIGS. 5A and 5B are sectional views showing the end beam 11 and the anti-climbers 9. FIG. 5A is a sectional view taken along line VA-VA of FIG. 3 and showing the end beam 11 and the anti-climbers 9. FIG. 5B is a sectional view taken along line VB-VB of FIG. 3 and showing the end beam 11 and the anti-climbers 9. FIG. 5A is a sectional view showing the end beam 11 and the anti-climbers 9 at a portion where a below-described cutout is not formed. FIG. 5B is a sectional view showing the end beam 11 and the anti-climbers 9 at a portion where the cutout is formed.

As shown in FIG. 1, in the present embodiment, the anti-climbers 9 extend between the side sills 16 in the car width direction entirely except for the cutouts. In the present embodiment, the anti-climbers 9 are disposed in an upper-lower direction. In the present embodiment, three anti-climbers 9 are disposed in the upper-lower direction. In the present embodiment, each of the anti-climbers 9 disposed in the upper-lower direction is formed in a flange shape and projects outward in the car longitudinal direction. The anti-climber disposed at an upper side in a height direction is referred to as an upper-stage anti-climber 9*a*. The anti-climber disposed at a middle stage in the height direction is referred to as a middle-stage anti-climber 9*b*. The anti-climber disposed at a lower side in the height direction is referred to as a lower-stage anti-climber 9*c*.

The anti-climber 9 includes cutouts 23 (starting point portions) formed by partially cutting out the anti-climber 9 in the car width direction. In the present embodiment, the cutouts 23 are formed at the middle-stage anti-climber 9*b*. Each cutout 23 may be a gap between plates lined up in the car width direction by cutting a part of the middle-stage anti-climber in the car width direction or may be formed by cutting out only a front end-side region of a part of the middle-stage anti-climber 9*b* in the car width direction. As shown in FIG. 5B, at a portion where the cutout 23 is formed in a section of a surface in the vicinity of the tip portion of the end beam 11 which surface is orthogonal to the car width direction, the middle-stage anti-climber 9*b* is not formed, and only the upper-stage anti-climber 9*a* and the lower-stage anti-climber 9*c* are formed.

As shown in FIG. 3, in the present embodiment, when viewed from the car longitudinal direction, the cutout 23 is disposed at a portion of the middle-stage anti-climber 9*b* which portion corresponds to a position between a front end 15*a* of the outer energy absorber 15 of the energy absorber 8 and the corner post 7 in the car width direction. A region between the front end 15*a* and the corner post 7 is referred to as a region R2. The cutout 23 is formed inside the region R2.

Moreover, in the present embodiment, the cutout 23 is disposed at a portion corresponding to a position at a car body middle side of a center between the front end 15*a* of the outer energy absorber 15 and the corner post 7 in the car width direction. FIG. 3 shows a straight line L1 which passes through the center between the front end 15*a* of the outer energy absorber 15 and the corner post 7 and extends in the car longitudinal direction. As shown in FIG. 3, in the present embodiment, the cutout 23 is disposed at a portion corresponding to a position at a car body middle side of the straight line L1 in the car width direction.

As shown in FIGS. 1-3, each of the pair of corner posts 7 projects upward toward the roof bodyshell 5 from a position in the vicinity of a car width direction end portion of the end beam 11. The pair of corner posts 7 are arranged bilaterally symmetrically in the car width direction. The pair of collision posts 6 are arranged between the pair of corner posts 7 in the car width direction and project upward from the end beam 11 toward the roof bodyshell 5. The pair of collision posts 6 are arranged bilaterally symmetrically in the car width direction. Lower ends of the collision posts 6 and the corner posts 7 are joined to the end beam 9 of the underframe 4 by welding, and upper ends thereof are joined to the roof bodyshell 5 by welding. The collision posts 6 are arranged at an outermost side in the car longitudinal direction among posts connecting the underframe 4 and the roof bodyshell 5. In examples shown in FIGS. 1-3, the collision posts 6 are arranged at an outer side of the corner posts 7 in the car longitudinal direction. However, the positions of the collision posts 6 in the car longitudinal direction may be the same as the positions of the corner posts 7 in the car longitudinal direction.

According to the above configuration, since the upper plate portion 19 is joined to the end beam main body portion 17 by the slot welding, fracture at the welded portion where the upper plate portion 19 and the end beam main body portion 17 are welded to each other is suppressed, and peel-off of the upper plate portion 19 from the end beam main body portion 17 can be suppressed. Moreover, since the lower plate portion 20 is joined to the end beam main body portion 17 by the slot welding, fracture at the welded portion where the lower plate portion 20 and the end beam main body portion 17 are welded to each other is suppressed, and peel-off of the lower plate portion 20 from the end beam main body portion 17 can be suppressed.

Moreover, since the portions of the upper and lower plate portions 19 and 20 which portions are located at the outermost positions in the car longitudinal direction are formed in the comb tooth shape, the welded portion 24 where the upper plate portion 19 and the end beam main body portion 17 are welded to each other and the welded portion 25 where the lower plate portion 20 and the end beam main body portion 17 are welded to each other become long in length. Therefore, the strength of the welding between the upper plate portion 19 and the end beam main body portion 17 and the strength of the welding between the lower plate portion 20 and the end beam main body portion 17 can be made high.

Moreover, the bodyshell 3 includes the anti-climbers 9. Therefore, when railcars collide with each other, the anti-climbers of the railcars that have collided with each other mesh with each other, and this can prevent one of the railcars from running on to the other railcar. Thus, the safety of the railcar is improved.

Figure 6:
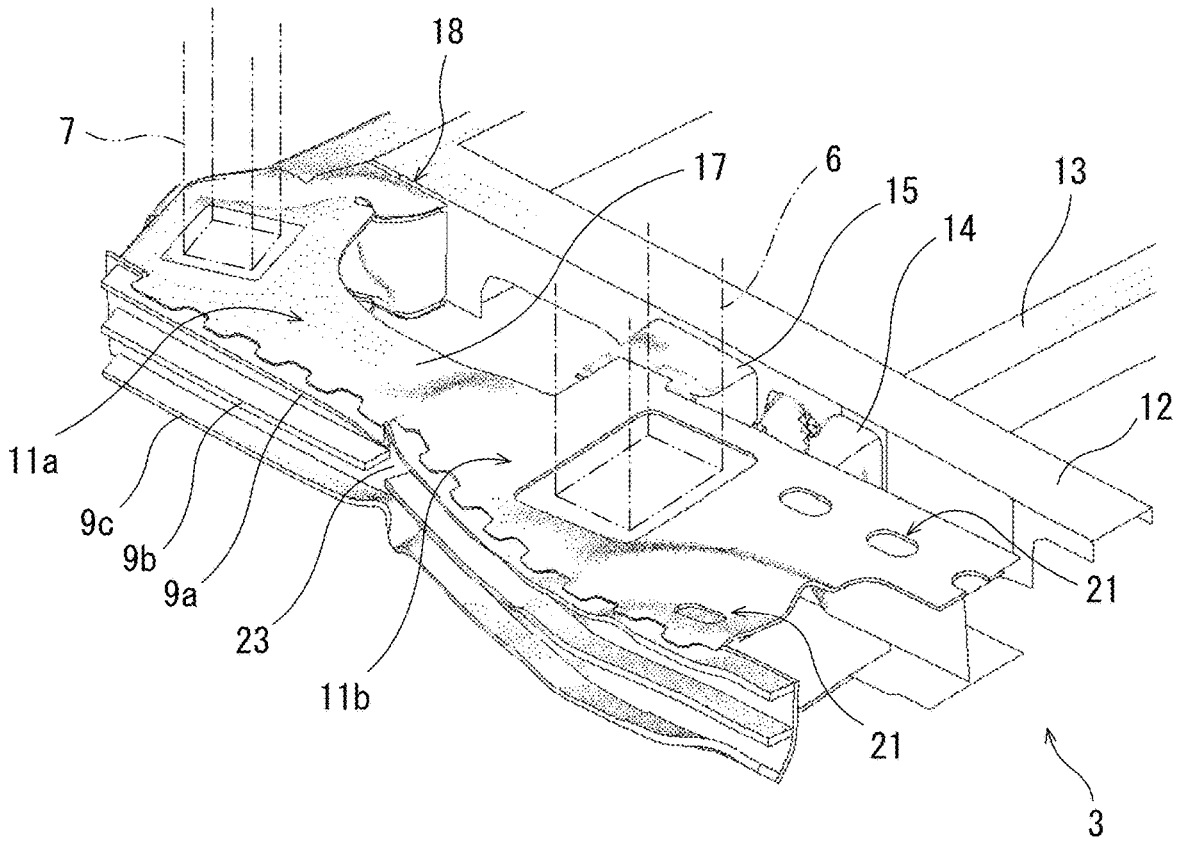
FIG. 6 is an enlarged perspective view showing only one side of the bodyshell of FIG. 1 in the car width direction when the bodyshell has collided and crushed.
Figure 7:
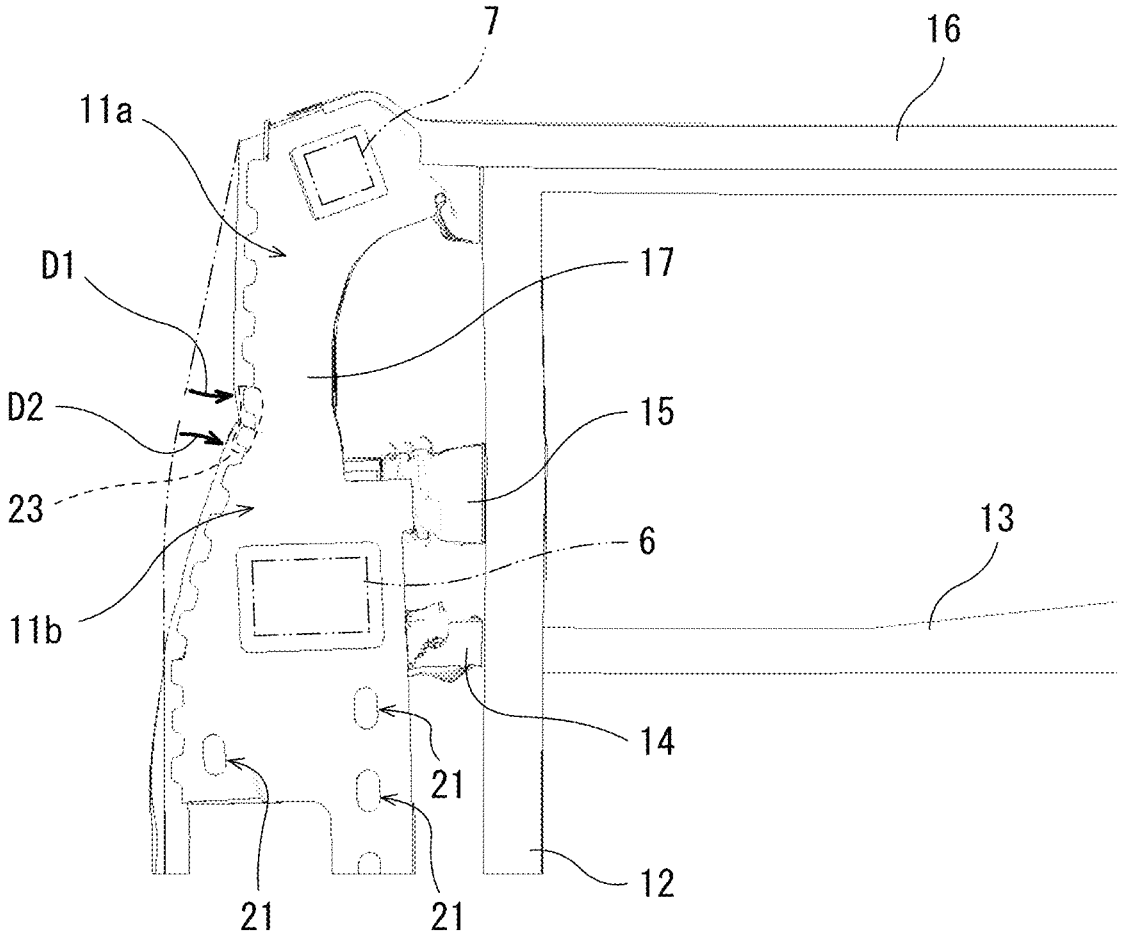
FIG. 7 is a plan view showing the bodyshell of FIG. 6.

The following will describe the state of the deformation of the bodyshell 3 of the railcar 1 when the collision has occurred. FIG. 6 is a perspective view showing the bodyshell 3 that has collided and crushed. FIG. 7 is a plan view showing the bodyshell 3 that has collided and crushed.

In the bodyshell 3, a region in front of the frame 12 is constituted as a crushable zone that is relatively allowed to deform when collision has occurred, and a region behind the frame 12 is constituted as a survival zone that is not relatively allowed to deform when collision has occurred. When collision has occurred, the crushable zone of the bodyshell 3 intensively crushes, and with this, the collision energy is absorbed by the crushable zone.

When the bodyshell 3 has collided, a load acts on the bodyshell 3 from a front side. In the present embodiment, the car width direction middle portion of the end beam 11 most projects forward. Therefore, when collision has occurred, a collision load acts on a tip of the car width direction middle portion. When the collision load acts on a front side of the bodyshell 3, the inner energy absorbers 14 and the outer energy absorbers 15 crush in a car front-rear direction. Moreover, in the region R1 behind the corner post 7, a portion (corner post rear region R1) of the end beam 11 which portion is located between the corner post 7 and the side coupling portion 18 crushes in the car front-rear direction. Since the inner energy absorbers 14, the outer energy absorbers 15, and the corner post rear regions R1 of the end beam 11 crush, the collision energy is absorbed by the inner energy absorbers 14, the outer energy absorbers 15, and the end beam 11.

In addition to this, since the cutout 23 is formed at the anti-climber 9*b*, the cutout 23 serves as a starting point, and the end beam 11 is bent at a position corresponding to the cutout 23. When the end beam 11 is bent, plastic deformation of the end beam 11 occurs such that a bent portion of the end beam 11 becomes a plastic hinge. Specifically, an outer end beam 11*a* located outside the cutout 23 in the car width direction in the bent end beam 11 rotates about the corner post 7, and an inner end beam 11*b* located inside the cutout 23 in the car width direction in the bent end beam 11 rotates about the collision post 6. FIG. 7 shows a rotational direction D1 of the outer end beam 11*a* and a rotational direction D2 of the inner end beam 11*b*.

Since the outer end beam 11*a* rotates about the corner post 7 in the rotational direction D1, part of the collision energy is consumed by the rotation of the outer end beam 11*a*. Moreover, since the inner end beam 11*b* rotates about the collision post 6 in the rotational direction D2, part of the collision energy is consumed by the rotation of the inner end beam 11*b*. Therefore, a peak value of the collision load can be made small.

Figure 8:
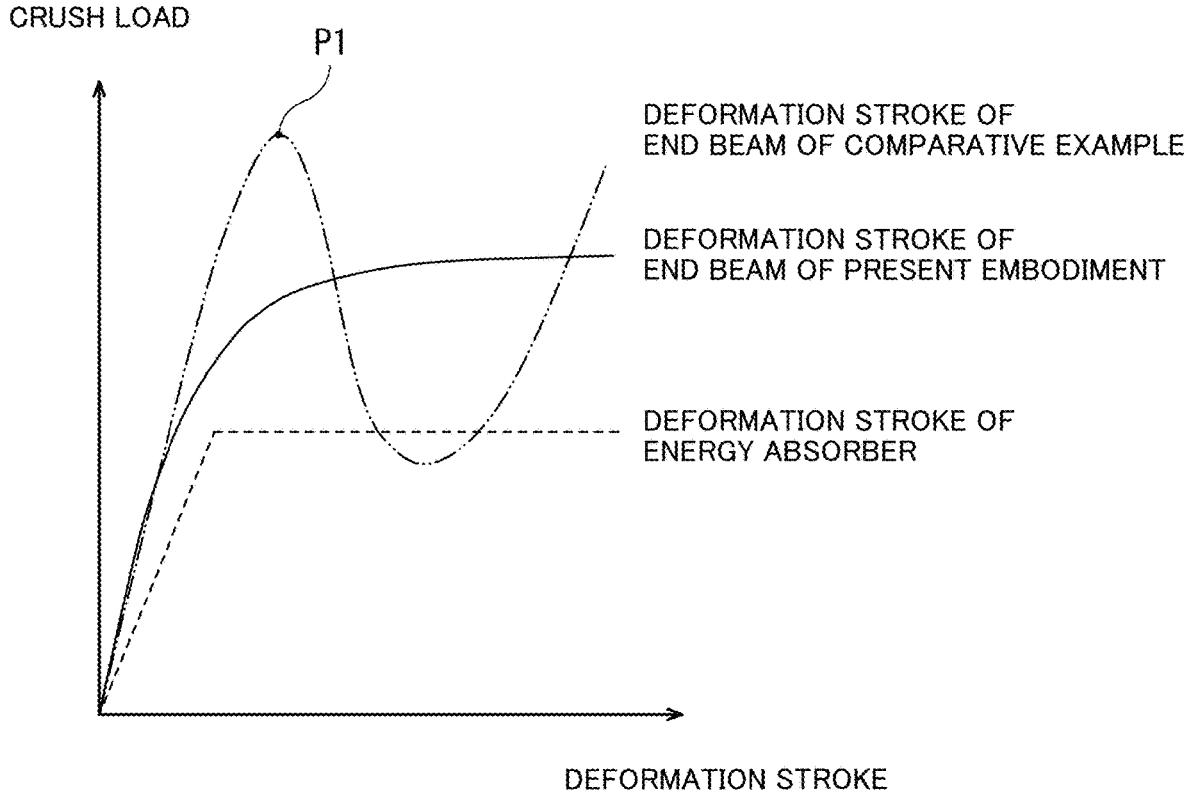
FIG. 8 is a graph showing a relation between a crush load acting on an end beam when the bodyshell of FIG. 1 has collided and a deformation stroke of the end beam.

FIG. 8 is a graph showing a relation between a crush load acting on the end beam and a deformation stroke. The deformation stroke of the end beam 11 of the present embodiment is shown by a solid line. The deformation stroke of Comparative Example is shown by a two-dot chain line. The deformation stroke of the energy absorber 8 is shown by a broken line. Comparative Example shows the deformation stroke of the end beam when the anti-climber does not include any cutouts.

In Comparative Example, the energy absorber crushes in the same manner as the bodyshell 3 of the present embodiment crushes. However, in Comparative Example, the anti-climber does not include any cutouts, and therefore, the end beam is hardly bent. Since the end beam is not bent, the end beam does not adequately absorb the collision energy. Even after the energy absorber crushes, the crush load continues to increase. After the energy absorber crushes, the crush load becomes the peak value at a point P1. When the crush load becomes the peak value, and the end beam adequately deforms, the crush load acting on the end beam decreases. After the crush load decreases to the limit, the crush load increases again.

On the other hand, in the bodyshell 3 of the present embodiment, the middle-stage anti-climber 9*b* includes the cutouts 23. Therefore, the bodyshell 3 can be configured such that when collision has occurred, as shown in FIGS. 6 and 7, the cutout 23 of the middle-stage anti-climber 9*b* serves as the starting point, and the end beam 11 is stably bent at a position corresponding to the cutout 23. On this account, the state of the deformation of the bodyshell 3 can be further stabilized. With this, the behavior of the deformation of the bodyshell 3 can be predicted, and the shape of the bodyshell 3 can be determined based on the predicted behavior of the deformation.

Moreover, in the present embodiment, the anti-climber 9*b* includes the cutouts 23. Therefore, when collision has occurred, the end beam 11 is surely bent at a position corresponding to the cutout 23. When the end beam 11 is bent, the outer end beam 11*a* and the inner end beam 11*b* rotate. On this account, the collision energy generated by the collision is consumed by the rotation of the outer end beam 11*a* and the rotation of the inner end beam 11*b*, and this can absorb the collision energy. With this, the peak value of the collision load acting on the end beam 11 can be made small. Moreover, the collision load transmitted to the survival zone located behind the frame 12 can be made low, and this can reduce the deformation amount of the survival zone.

Moreover, since the peak value of the collision load acting on the end beam 11 can be made small, as shown by the solid line in the graph of FIG. 8, the inclination of the deformation stroke of the end beam 11 of the present embodiment can be made gentle. In the graph of FIG. 8, the deformation stroke of the deformation of the end beam 11 of the present embodiment simply and gently increases. With this, the state of the deformation of the end beam 11 when collision has occurred can be stabilized.

On the other hand, when the anti-climber does not include any cutouts as in Comparative Example, the state of the deformation of the end beam is unstable, and the state of the deformation of the end beam is unpredictable. Therefore, the unintentional state of the deformation of the end beam may occur, and a large load may locally act.

Moreover, in the present embodiment, the upper plate portion 19 and the end beam main body portion 17 are joined to each other by the slot welding using the through holes 21. Therefore, when collision has occurred, as shown in FIGS. 6 and 7, the upper plate portion 19 surely deforms so as to follow the deformation of the end beam main body portion 17. On this account, the plastic deformation of the upper plate portion 19 is caused by the plastic deformation of the end beam main body portion 17. When the outer end beam 11*a* rotates about the corner post 7 in the rotational direction D1, a portion of the upper plate portion 19 which portion corresponds to the outer end beam 11*a* deforms by the rotation of the outer end beam 11*a*. Moreover, when the inner end beam 11*b* rotates about the collision post 6 in the rotational direction D2, a portion of the upper plate portion 19 which portion corresponds to the inner end beam 11*b* deforms by the rotation of the inner end beam 11*b*. With this, part of the collision energy generated by the collision is consumed by the plastic deformation of the upper plate portion 19. Therefore, the peak value of the collision load can be made further small, and this can further reduce the deformation amount of the survival zone. Similarly, the lower plate portion 20 and the end beam main body portion 17 are joined to each other by the slot welding using the through holes 22. Therefore, when the bodyshell 3 has collided, the lower plate portion 20 surely deforms so as to follow the deformation of the end beam main body portion 17. On this account, the plastic deformation of the lower plate portion 20 is caused by the plastic deformation of the end beam main body portion 17. When the outer end beam 11*a* rotates about the corner post 7 in the rotational direction D1, a portion of the lower plate portion 20 which portion corresponds to the outer end beam 11*a* deforms by the rotation of the outer end beam 11*a*. Moreover, when the inner end beam 11*b* rotates about the collision post 6 in the rotational direction D2, a portion of the lower plate portion 20 which portion corresponds to the inner end beam 11*b* deforms by the rotation of the inner end beam 11*b*. With this, part of the collision energy generated by the collision is consumed by the plastic deformation of the lower plate portion 20. Therefore, the peak value of the collision load can be made further small, and this can further reduce the deformation amount of the survival zone.

Moreover, since the welded portion 24 where the upper plate portion 19 and the end beam main body portion 17 are welded to each other is formed in the comb tooth shape, the strength of the welding between the upper plate portion 19 and the end beam main body portion 17 is made high. Therefore, when the outer end beam 11*a* and the inner end beam 11*b* move, the upper plate portion 19 surely deforms so as to follow the movements of the outer end beam 11*a* and the inner end beam 11*b*. On this account, the collision energy can be further efficiently absorbed, and the peak value of the collision load can be made further small. Similarly, since the welded portion 25 where the lower plate portion 20 and the end beam main body portion 17 are welded to each other is formed in the comb tooth shape, the strength of the welding between the lower plate portion 20 and the end beam main body portion 17 is made high. Therefore, when the outer end beam 11*a* and the inner end beam 11*b* move, the lower plate portion 20 surely deforms so as to follow the movements of the outer end beam 11*a* and the inner end beam 11*b*. On this account, the collision energy can be further efficiently absorbed, and the peak value of the collision load can be made further small.

In the present embodiment, the upper plate portion 19 and the end beam main body portion 17 are welded to each other by the slot welding using the through holes 21, and the tip portion of the upper plate portion 19 is formed in the comb tooth shape. Therefore, the strength of the welding between the upper plate portion 19 and the end beam main body portion 17 is made high. Moreover, the lower plate portion 20 and the end beam main body portion 17 are welded to each other by the slot welding using the through holes 22, and the tip portion of the lower plate portion 20 is formed in the comb tooth shape. Therefore, the strength of the welding between the lower plate portion 20 and the end beam main body portion 17 is made high. Since the upper plate portion 19 and the lower plate portion 20 are prevented from being peeled off from the end beam main body portion 17, large collision energy can be prevented from acting only on the end beam main body portion 17. Thus, the peak of the collision load acting on the end beam main body portion 17 can be made small. Moreover, since the peak value of the collision load acting on the end beam main body portion 17 by the collision can be made small, the deformation of the end beam main body portion 17 can be made gentle. Therefore, the behavior of the deformation of the end beam main body portion 17 is stabilized, and the energy absorber 8 can appropriately function. In the present embodiment, as a result, the peak value of the crush load acting on the end beam 11 disappears as shown in FIG. 8, and the load monotonically increases. Then, the deformation terminates.

Moreover, in the present embodiment, the sectional area A1 of the surface of the side coupling portion 18 of the end beam 11 which surface is orthogonal to the car longitudinal direction is smaller than the sectional area A2 of the surface of the end beam 11 which surface is orthogonal to the car longitudinal direction and located at a car end side position of the side coupling portion 18. Therefore, in the corner post rear region R1, the rigidity of the end beam 11 in the car longitudinal direction becomes low at a position in the vicinity of the side coupling portion 18. In the corner post rear region R1, the rigidity of the first portion 26 of the end beam 11 in the car longitudinal direction is higher than the rigidity of the second portion 27 of the end beam in the car longitudinal direction, and the second portion 27 of the end beam 11 crushes more easily than the first portion 26. On this account, when collision has occurred, the corner post rear region R1 crushes at the second portion 27 that is a position of the end beam 11 which position is closer to the side coupling portion 18 than the first portion 26. This position becomes the starting point of the rotation of the outer end beam 11*a* about the corner post 7. With this, the rotation of the outer end beam 11*a* about the corner post 7 can be surely performed, and the state of the deformation of the end beam 11 can be stabilized.

Moreover, in the corner post rear region R1 of the end beam 11, the position close to the side coupling portion 18 surely crushes. Therefore, the energy absorber 8 arranged side by side with the side coupling portion 18 can be made to surely crush. On this account, the energy absorber 8 can be made to surely function, and the state of the deformation of the end beam 11 can be further stabilized.

Moreover, the cutout 23 of the anti-climber 9*b* is disposed at a position located at a car body middle side of a center L1 between the front end 15*a* of the outer energy absorber 15 and the corner post 7 in the car width direction. With this, a long distance between the cutout 23 and the corner post 7 is secured. As a result, a distance between the position that is the starting point of the plastic hinge in the end beam 11 and the corner post 7 becomes long, and the long length of the outer end beam 11*a* can be secured. Since the bodyshell 3 is configured as above, a rotational moment acting on the outer end beam 11*a* when collision has occurred can be increased. Therefore, the collision energy can be further efficiently absorbed by the rotation of the outer end beam 11*a*, and the collision load can be made further low.

Moreover, the end beam 11 is configured such that the car width direction middle portion thereof has a shape projecting outward in the car longitudinal direction. Therefore, when collision has occurred, the collision load tends to act on the tip of the car width direction middle portion, and the state of the deformation of the bodyshell 3 can be further stabilized. Since the bodyshell 3 deforms by the stable behavior, the shape of the bodyshell 3 can be determined in accordance with the state of the deformation of the bodyshell 3.

The above embodiment has described a case where the cutout 23 is formed such that a part of the middle-stage anti-climber 9*b* in the car width direction is cut out entirely in the car longitudinal direction. However, the cutout 23 is not limited to the above embodiment. The cutout may be formed such that: a part of the middle-stage anti-climber in the car longitudinal direction is partially cut out; and the length of the middle-stage anti-climber in the car longitudinal direction is made partially short. Moreover, a portion where the cutout is formed does not have to be the middle-stage anti-climber. The cutout may be formed at the upper-stage anti-climber or the lower-stage anti-climber.

Moreover, the above embodiment has described a case where three anti-climbers are formed in the upper-lower direction. However, the number of anti-climbers is not limited to the above embodiment. The number of anti-climbers may be one, two, or four or more. In this case, the cutout may be provided at any of the anti-climbers disposed in the upper-lower direction. Moreover, the above embodiment is not limited to a case where the cutouts are formed at only one of the anti-climbers disposed in the upper-lower direction. For example, the cutouts may be disposed at two out of three anti-climbers disposed in the upper-lower direction or may be disposed at all of the three anti-climbers. To be specific, the cutouts may be disposed at the anti-climbers among the anti-climbers disposed in the upper-lower direction. The cutout may be disposed at the anti-climber in any manner as long as the state of the deformation of the end beam when collision has occurred is stabilized since the cutout is disposed at a part of the anti-climber.

Moreover, the above embodiment has described a case where the cutout 23 is disposed at a position of the middle-stage anti-climber 9*b* which position is located at the car body middle side of the center L1 between the front end 15*a* of the outer energy absorber 15 of the end beam 11 and the corner post 7 in the car width direction. However, the position of the cutout 23 is not limited to the above embodiment. The cutout 23 may be disposed at a position located outside the center L1 between the front end 15*a* of the outer energy absorber 15 of the end beam 11 and the corner post 7 in the car width direction. As long as the cutout 23 is disposed at a portion corresponding to a position between the front end 15*a* of the energy absorber 15 and the corner post 7 in the car width direction, the cutout 23 does not have to be disposed at a position located at the car body middle side of the center L1 between the front end 15*a* of the outer energy absorber 15 of the end beam 11 and the corner post 7.

Embodiment 2

Next, the railcar bodyshell according to Embodiment 2 will be described. Explanations of components that are the same as those of Embodiment 1 are omitted, and only different components will be described. In Embodiment 1, the railcar bodyshell 3 is configured such that: the cutouts are disposed at the anti-climber; and when collision has occurred, the cutouts of the anti-climber serve as the starting points, and the end beam is stably bent at the cutouts. In a railcar bodyshell 3*a* of Embodiment 2, the cutouts are disposed at the anti-climber. In addition, Embodiment 2 is different from Embodiment 1 in that holes are disposed at positions of a front end of the end beam which positions correspond to the cutouts of the anti-climber.

Figure 9:
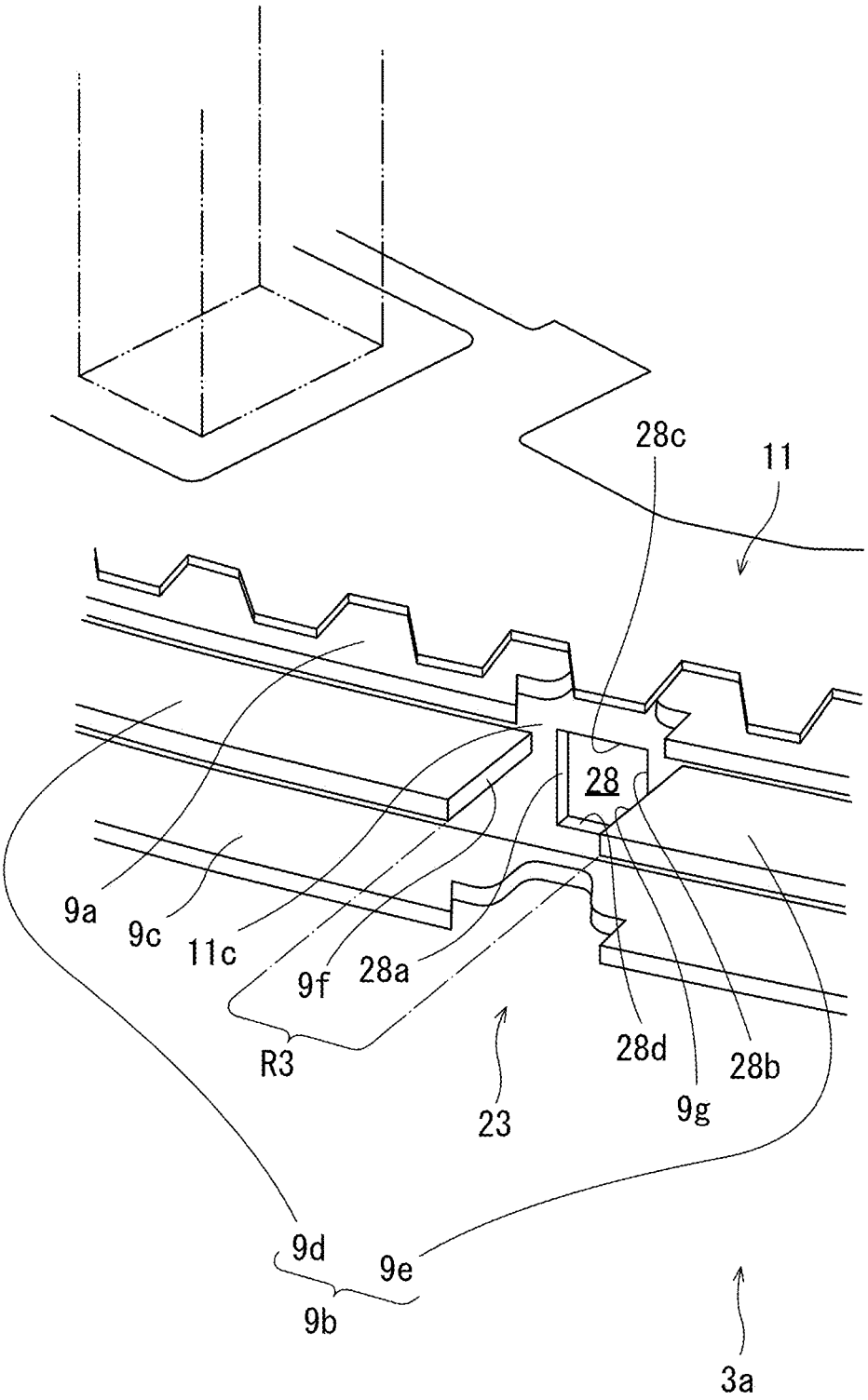
FIG. 9 is an enlarged perspective view showing only the other side of the railcar bodyshell according to Embodiment 2 of the present invention in the car width direction.

FIG. 9 is a perspective view showing the vicinity of the cutout 23 disposed at the middle-stage anti-climber 9*b* in Embodiment 2. FIG. 9 shows the vicinity of only one of two cutouts 23 disposed at the middle-stage anti-climber 9*b*. A portion shown in FIG. 9 corresponds to only one side of the railcar bodyshell 3*a* and is an opposite side of the portion shown in FIG. 2 in the car width direction.

The middle-stage anti-climber 9*b* includes a middle-side middle-stage anti-climber 9*d* and an outer-side middle-stage anti-climber 9*e* which sandwich the cutout 23. The middle-side middle-stage anti-climber 9*d* includes an outer end 9*f* that is an outer-side end portion in the car width direction, and the outer-side middle-stage anti-climber 9*e* includes an inner end 9*g* that is a middle-side end portion in the car width direction. A region between the outer end 9*f* of the middle-side middle-stage anti-climber 9*d* and the inner end 9*g* of the outer-side middle-stage anti-climber 9*e* is referred to as a cutout region R3.

The end beam 11 includes a front wall 11*c* that is a wall constituting the front end of the end beam 11 in the car longitudinal direction. A front hole 28 that penetrates the front wall 11*c* in the car longitudinal direction is disposed in a region of the front wall 11*c* which region corresponds to the cutout region R3. The front hole 28 includes: a car width direction middle-side end portion 28*a*; a car width direction outer-side end portion 28*b*; an upper-lower direction upper-side end portion 28*c*; and an upper-lower direction lower-side end portion 28*d*. The region of the front wall 11*c* which region corresponds to the cutout region R3 denotes a region of the front wall 11*c* which region is located between the outer end 9*f* of the middle-side middle-stage anti-climber 9*d* and the inner end 9*g* of the outer-side middle-stage anti-climber 9*e* in the car width direction. In the present embodiment, the car width direction middle-side end portion 28*a* of the front hole 28 is located outside the outer end 9*f* of the middle-side middle-stage anti-climber 9*d* in the car width direction, and the car width direction outer-side end portion 28*b* of the front hole 28 is located inside the inner end 9*g* of the outer-side middle-stage anti-climber 9*e* in the car width direction. In the present embodiment, over the entire front hole 28 in the upper-lower direction, the front hole 28 is disposed at the front wall 11*c* so as to be located within a region between the outer end 9*f* of the middle-side middle-stage anti-climber 9*d* and the inner end 9*g* of the outer-side middle-stage anti-climber 9*e* in the car width direction. Moreover, in the present embodiment, the front hole 28 is disposed between the upper-stage anti-climber 9*a* and the lower-stage anti-climber 9*c* in the upper-lower direction. The upper-side end portion 28*c* of the front hole 28 is located lower than the upper-stage anti-climber 9*a*, and the lower-side end portion 28*d* of the front hole 28 is located higher than the lower-stage anti-climber 9*c*. In the present embodiment, over the entire front hole 28 in the car width direction, the front hole 28 is disposed at the front wall 11*c* so as to be located within a region between the upper-stage anti-climber 9*a* and the lower-stage anti-climber 9*c*.

The railcar bodyshell 3*a* is configured bilaterally symmetrically in the car width direction. Therefore, the cutout 23 is similarly disposed at the opposite side of FIG. 9 in the car width direction. Moreover, the front hole 28 is disposed in a region of the front wall 11*c* which region corresponds to the cutout region R3.

In Embodiment 2, the front hole 28 that penetrates the front wall 11*c* of the end beam 11 in the car longitudinal direction is disposed. Therefore, the railcar bodyshell 3*a* is configured such that when collision has occurred, both the cutout 23 of the middle-stage anti-climber 9*b* and the front hole 28 of the end beam 11 serve as the starting points, and the end beam 11 is bent at the cutout 23 and the front hole 28. On this account, the bodyshell 3*a* can be configured such that when collision has occurred, the cutouts 23 of the middle-stage anti-climber 9*b* and the front hole 28 of the end beam 11 serve as the starting points, and the end beam 11 is more stably bent at positions corresponding to the cutouts 23 and the front hole 28. Thus, the state of the deformation of the bodyshell 3*a* can be further stabilized.

OTHER EMBODIMENTS

The above embodiment has described a case where the anti-climber 9 includes the cutout 23 as the starting point portion that serves as the starting point of the bending of the end beam 11 when the bodyshell 3 of the railcar 1 has collided, and the end beam 11 is bent by the collision load. However, the starting point portion is not limited to the above embodiment. The starting point portion that serves as the starting point of the bending of the end beam 11 when the bodyshell 3 of the railcar 1 has collided does not have to be the cutout. For example, a part of the anti-climber may include a region whose strength is lower than that of the other part, and the part of the anti-climber may be the starting point portion that serves as the starting point of the bending of the end beam 11 when the end beam 11 is bent. For example, as the above region whose strength is low, a hole or a thin portion may be used instead of the cutout. Moreover, when a hole, a thin portion, or the like is used as the starting point portion instead of the cutout, a hole that penetrates the wall of the front end of the end beam in the car longitudinal direction as described in Embodiment 2 may be additionally disposed at the end beam.

The invention claimed is:

1. A railcar bodyshell comprising:

an underframe including an underframe main body and an end beam, the end beam being disposed at one of end portions of the underframe main body in a car longitudinal direction and extending in a car width direction;

a corner post connecting the underframe and a roof bodyshell;

an energy absorber that is arranged between the end beam and the underframe main body and absorbs part of collision energy; and an anti-climber that projects from the end beam outward in the car longitudinal direction and extends in the car width direction, wherein:

the end beam includes an end beam main body portion and a side coupling portion, the side coupling portion connecting the end beam main body portion to the underframe main body in a corner post rear region that extends from the corner post inward in the car longitudinal direction;

the anti-climber includes a starting point portion that serves as a starting point of bending of the end beam when collision has occurred, and the end beam is bent by a collision load;

the starting point portion is disposed at a portion corresponding to a position between a front end of the energy absorber and the corner post in the car width direction; and the starting point portion includes a cutout located at a part of the anti-climber in the car width direction.

2. The railcar bodyshell according to claim 1, wherein:

the end beam includes a front hole at a front end thereof, the front hole being located in a region corresponding to the cutout of the anti-climber and penetrating a wall of the end beam in the car longitudinal direction.

3. The railcar bodyshell according to claim 1, wherein:

the anti-climber includes an upper-stage anti-climber, a middle-stage anti-climber, and a lower-stage anti-climber which are lined up in a vertical direction at intervals; and the cutout is located at the middle-stage anti-climber.

4. The railcar bodyshell according to claim 1, wherein the starting point portion is disposed at a position located at a car body middle side of a center between the front end of the energy absorber of the end beam and the corner post in the car width direction.

5. The railcar bodyshell according to claim 1, wherein a car width direction middle portion of a car front portion of the end beam projects outward in the car longitudinal direction.

6. A railcar bodyshell, comprising:

an underframe including an underframe main body and an end beam, the end beam being disposed at one of end portions of the underframe main body in a car longitudinal direction and extending in a car width direction;

a corner post connecting the underframe and a roof bodyshell;

an energy absorber that is arranged between the end beam and the underframe main body and absorbs part of collision energy; and an anti-climber that projects from the end beam outward in the car longitudinal direction and extends in the car width direction, wherein:

the end beam includes an end beam main body portion and a side coupling portion, the side coupling portion connecting the end beam main body portion to the underframe main body in a corner post rear region that extends from the corner post inward in the car longitudinal direction;

the anti-climber includes a starting point portion that serves as a starting point of bending of the end beam when collision has occurred, and the end beam is bent by a collision load;

the starting point portion is disposed at a portion corresponding to a position between a front end of the energy absorber and the corner post in the car width direction;

the starting point portion includes at least one of a cutout located at a part of the anti-climber in the car width direction, a thin portion located at a part of the anti-climber and thinner than the other portion of the anti-climber, or a hole penetrating a wall of a front end of the end beam in the car longitudinal direction;

the end beam includes:

a first portion located adjacent to and behind the corner post; and a second portion located behind the first portion, and rigidity of the first portion of the end beam in the car longitudinal direction is higher than rigidity of the second portion of the end beam in the car longitudinal direction.

7. A railcar bodyshell, comprising:

an underframe including an underframe main body and an end beam, the end beam being disposed at one of end portions of the underframe main body in a car longitudinal direction and extending in a car width direction;

a corner post connecting the underframe and a roof bodyshell;

an energy absorber that is arranged between the end beam and the underframe main body and absorbs part of collision energy; and an anti-climber that projects from the end beam outward in the car longitudinal direction and extends in the car width direction, wherein:

the end beam includes an end beam main body portion and a side coupling portion, the side coupling portion connecting the end beam main body portion to the underframe main body in a corner post rear region that extends from the corner post inward in the car longitudinal direction;

the anti-climber includes a starting point portion that serves as a starting point of bending of the end beam when collision has occurred, and the end beam is bent by a collision load;

the starting point portion is disposed at a portion corresponding to a position between a front end of the energy absorber and the corner post in the car width direction;

the starting point portion includes at least one of a cutout located at a part of the anti-climber in the car width direction, a thin portion located at a part of the anti-climber and thinner than the other portion of the anti-climber, or a hole penetrating a wall of a front end of the end beam in the car longitudinal direction;

the end beam includes an upper plate portion that is attached to an upper portion of the end beam main body portion and includes a through hole; and the upper plate portion is attached to the end beam main body portion by continuous fillet welding along an edge portion surrounding the through hole.

8. A railcar bodyshell, comprising:

an underframe including an underframe main body and an end beam, the end beam being disposed at one of end portions of the underframe main body in a car longitudinal direction and extending in a car width direction;

a corner post connecting the underframe and a roof bodyshell;

an energy absorber that is arranged between the end beam and the underframe main body and absorbs part of collision energy; and an anti-climber that projects from the end beam outward in the car longitudinal direction and extends in the car width direction, wherein:

the end beam includes an end beam main body portion and a side coupling portion, the side coupling portion connecting the end beam main body portion to the underframe main body in a corner post rear region that extends from the corner post inward in the car longitudinal direction;

the anti-climber includes a starting point portion that serves as a starting point of bending of the end beam when collision has occurred, and the end beam is bent by a collision load;

the starting point portion is disposed at a portion corresponding to a position between a front end of the energy absorber and the corner post in the car width direction;

the starting point portion includes at least one of a cutout located at a part of the anti-climber in the car width direction, a thin portion located at a part of the anti-climber and thinner than the other portion of the anti-climber, or a hole penetrating a wall of a front end of the end beam in the car longitudinal direction;

the end beam includes a lower plate portion that is attached to a lower portion of the end beam main body portion and includes a through hole; and the lower plate portion is attached to the end beam main body portion by continuous fillet welding along an edge portion surrounding the through hole.

* * * * *